US011019977B2

(12) United States Patent
Bahri

(10) Patent No.: US 11,019,977 B2
(45) Date of Patent: Jun. 1, 2021

(54) CLEANING HEAD, A COMBINATION OF A CLEANING HEAD, A WATER PERMEABLE BAG AND CLEANING MEMBERS, AND A COMBINATION OF A CLEANING HEAD AND A BUCKET WITH A PUMP

(71) Applicant: Boudali Bahri, VC Leiden (NL)

(72) Inventor: Boudali Bahri, VC Leiden (NL)

( * ) Notice: Subject to any disclaimer, the term of this patent is extended or adjusted under 35 U.S.C. 154(b) by 0 days.

(21) Appl. No.: 16/091,619

(22) PCT Filed: Apr. 10, 2017

(86) PCT No.: PCT/NL2017/050223

§ 371 (c)(1),
(2) Date: Oct. 5, 2018

(87) PCT Pub. No.: WO2017/176120

PCT Pub. Date: Oct. 12, 2017

(65) Prior Publication Data

US 2019/0117036 A1 Apr. 25, 2019

(30) Foreign Application Priority Data

Apr. 8, 2016 (NL) ..... 2016570

(51) Int. Cl.
*A47L 13/253* (2006.01)
*A47L 13/58* (2006.01)

(52) U.S. Cl.
CPC ..... *A47L 13/253* (2013.01); *A47L 13/58* (2013.01)

(58) Field of Classification Search
CPC ..... A47L 13/253; A47L 13/58
See application file for complete search history.

(56) References Cited

U.S. PATENT DOCUMENTS

| | | | | |
|---|---|---|---|---|
| 4,881,290 | A * | 11/1989 | Bohacek | A47L 13/253 15/228 |
| 5,218,734 | A * | 6/1993 | Sacks | A47L 13/258 15/147.1 |
| 8,356,379 | B2 * | 1/2013 | Fischer | A47L 13/258 15/144.2 |
| 10,070,768 | B2 * | 9/2018 | Young | B08B 1/002 |
| 2014/0250618 | A1 * | 9/2014 | Howard | A47L 13/20 15/228 |
| 2015/0208894 | A1 * | 7/2015 | Salmon | A47L 13/253 15/147.1 |

* cited by examiner

*Primary Examiner* — Dung Van Nguyen
(74) *Attorney, Agent, or Firm* — FisherBroyles, LLP

(57) ABSTRACT

The invention relates to a cleaning head, comprising: —a base part with a central axis; and —a number of arms extending radially with respect to the central axis each having a first end that is connected to said base part, and a second free end, wherein said second end is displaceable between a starting position in which the second end of the arms is near the central axis, and a use mode wherein the second end of the arms is at a position remote from the central axis, and wherein the second ends of the arms in the use mode are in a same plane as said base part. The cleaning head is characterized in that the arms in de use mode are bendable in tangential direction with respect to each other around said base part.

17 Claims, 7 Drawing Sheets

CLEANING HEAD, A COMBINATION OF A CLEANING HEAD, A WATER PERMEABLE BAG AND CLEANING MEMBERS, AND A COMBINATION OF A CLEANING HEAD AND A BUCKET WITH A PUMP

PRIORITY APPLICATIONS

This application is a U.S. National Stage Filing under 35 U.S.C. 371 from International Application No. PCT/NL2017/050223, filed on 10 Apr. 2017 and published as WO 2017/176120 on 12 Oct. 2017, which claims the benefit of priority to Dutch Patent Application No. 2016570, filed 8 Apr. 2016, which applications and publication are incorporated herein by referenced in their entirety.

The present invention relates to a cleaning head, comprising:

a base part with a central axis; and a number of arms extending radially with respect to the central axis each having a first end that is connected to said base part, and a second free end, wherein said second end is displaceable between a starting position in which the second end of the arms is near the central axis, and a use mode wherein the second end of the arms is at a position remote from the central axis, and wherein the second ends of the arms in the use mode are in a same plane as said base part.

For performing cleaning activities the use of cleaning heads that can be connected to a stalk, is known. For example, such cleaning heads are used for cleaning floors, windows, walls or ceilings. Both wet cleaning (wherein the surface of the cleaning head that will contact the surface to be cleaned is wetted, usually in a combination with a cleaning agent like soap) or dry cleaning (without wetting, for example with brushes, feathers or cloths that catch dust) is envisaged.

A cleaning head according to the invention is known from German patent 10 2012 022127 A1. In that cleaning head a cloth is connected to a number of resilient and radially extending arms. The cloth is pushed against the surface to be cleaned by means of the arms. From that moment on, due to the positioning of the cloth, the arms can only be displaceable up and down (thus to the surface to be cleaned and away from said surface), which limits the scope of usability of the cleaning head, especially when the cleaning head reaches an obstacle, like a corner, an edge, or an object placed on the surface to be cleaned.

Thus, the contact of the cleaning head with the surface to be cleaned will be diminished, especially where the surfaces are strongly contaminated or irregular. Besides that, it can be difficult to control the behavior of the cleaning head and the contaminations it has gathered, such that the contaminations will be pushed towards the corners and remain therein, from where it will be hard to remove it therefrom in a later stage.

Many of such cleaning heads are prone to fungus growth and stench.

It is an object of the present invention to reduce or even prevent the above-mentioned problems.

This aims is obtained by means of a cleaning head according to the preamble, wherein the arms in de use mode are bendable in tangential direction with respect to each other around said base part.

In the use mode, the arms are at least bendable in a tangential direction, for example tiltable, relative to each other, which provides the advantage that the cleaning head is easier to place and shape around, for example, angles, shapes or edges of the surface to be cleaned, or for example objects such as tables or chairs on a surface to be cleaned.

One can also reach multiple corners at the same time. In most cases, two adjacent arms will spread, however, it is also possible that several arms concentrate. The displacement of the free ends of the arms can take place, for example, by a pivotal movement of the arms or deformation of the arms. The flexible part of the arms may be provided over the entire length of the arms or only over a part of the length of the arms. Incidentally, the invention is not limited to a pure geometric tangential direction in the plane in which it is placed during use. For example, they can also preferably move independently to a position outside that plane independently. A tension spring or similar construction provides such an advantageous embodiment In the use mode, the arms are substantially in the same plane, parallel to and in contact with the surface to be cleaned. In the starting position, the arms in the absence of a force forcing the arms into the use mode, will fix their shape, such that the cleaning head will stand with its arms on the surface. In this way, the arms release between them in a space (for example in a bowl form) so that air can enter the arms to prevent mold growth and, hence, stench. Cleaning apparatuses based on wires are also manufactured from individual wires that are attached to a base part and that, in a sense, can be tilted at their free ends in the tangential direction relative to each other, however, these wires are not in the same plane in the use mode, the cleaning Head can not stand in the starting position with the arms (i.e. the wires) on the surface, and also do not allow enough space to prevent fungus growth.

As an example, the cleaning head may be used for wet cleaning (For example as a mop), cry cleaning, steaming, scrubbing, sweeping, brushing, lashing or a combination of it to remove dust and dirt, and is applicable on several kinds of floors, walls, windscreens or windows.

In a preferred embodiment of the cleaning head according to the invention the cleaning head comprises cleaning zones in tangential direction at and preferably provided around the arms, and comprises openings in between the arms that extend into the direction of said base part.

The tangential rotatability of the arms may for example be obtained by providing openings between the arms, wherein the openings in the use mode extend over a substantial portion of of the radial dimension until a position near said base part (for example over about 75% or more of the radial dimension). This is contrary to for example the cleaning head that is known from German patent publication 10 2012 022127 A1, wherein between the arms a cloth is provided and that has such construction of the arms to said base part that a tilting movement in the use mode is prevented. The cleaning head may for example have a star shape. At and preferably around the arms a cleaning cloth may be attached, with which one can clean a surface.

In a further preferred embodiment of the cleaning head according to the invention the cleaning zones of at least one arm are at least at the outer side provided with protrusions that are positioned at an angle with respect to the longitudinal direction of the arm, and preferably directed towards the central axis, for holding or retaining dirt therein.

By providing protrusions, preferably pointed protrusions, at at least the outer side of the arms, along the longitudinal direction of the arm (preferably at least three at each side edge), dirt can attach to and between these protrusions, which simplifies cleaning with respect to other cleaning heads, herein dirt and dust are moved in particular forward rather than taken by the cleaning head. Directing the protrusions away from the longitudinal direction has the advantage that dirt that is attached to the cleaning head disturbs the cleaning process as little as possible.

In a further preferred embodiment of the cleaning head according to the invention the arms comprise a spring or a memory material. For example, only the core of the arms may comprise a spring or a memory material.

A spring, such as a draw spring, or a memory material is suitable for the fabrication of the arms because, when no force is applied, for example, it automatically returns from the use mode to the starting position. In use mode, it is possible to keep continuous pressure across the entire size of the surface to be cleaned underneath the cleaning head.

In yet another preferred embodiment of the cleaning head according to the invention, at least in the starting position the arms are arranged uniformly around said base part in a tangential direction.

Regular placement of the arms around the base part ensures that even cleaning is achieved. In addition, this increases the stability of the cleaning head.

Alternatively, in the cleaning head according to the invention, in the starting position the arms may be unevenly disposed around said base part when the cleaning head contains more than three arms, with the proviso that at least three arms are evenly spaced from said base portion to allow the cleaning head to be supported on those three arms, for example to remove the cleaning head and allow it to dry. This results in a minimum required stability of the cleaning head in the starting position.

In a further preferred embodiment of the cleaning head according to the invention, the number of arms is 3 or greater, and less than 9, and preferably less than 6, more preferably 4 or 5.

It is important that the number of arms is sufficient for easily obtaining an effective cleaning and a stable positioning in both the starting position and the use mode of the cleaning head. Consequently, the number of at least three arms (especially in combination with a placement in tangential direction) is preferred.

However, as mentioned before, too many arms means that when touching objects the arms may interfere each other's tilting movements in the tangential direction. For that reason, the number of arms is preferably less than 9 and more preferably less than 6, still more preferably 4 or 5.

In a further preferred embodiment of the cleaning head according to the invention the free end of at least one of the arms is pointed, or sharply shaped, preferably with a diameter of less than 2 cm, preferably less than 1 cm. For example, the arm may taper towards its free end.

When using a sharp or pointed free end it is easier to remove stubborn contamination such as caked dirt, opposed to when using rounded free edges. It then is also possible to control and observe the cleaning process, including the influence of dirt through the cleaning head. In such way, the cleaning movement can be adjusted at the right moment to the behavior of dirt in the cleaning head, so as to obtain a better, easier and more effective cleaning process. In the starting position these sharp points support on the surface to also allow space between the arms for drying to prevent mold growth.

In another preferred embodiment of the cleaning head according to the invention the cleaning head further comprises a stalk that is connected to said base part by means of fasteners.

When a stalk is coupled to the cleaning head (replaceable, for example by means of fasteners like clamps, screw tread, or another suitable solution), the cleaning head is easily controllable, especially when cleaning floors, ceilings or higher parts of walls, since one does not have to bend or apply scaffolding or ladders. In addition, a stalk allows one to easily apply more force on the arms so as to bring these into the use mode.

In a further preferred embodiment of the cleaning head according to the invention the stalk is connected non-rotatably in the fasteners such that said base part rotates upon rotation of the stalk around the central axis.

When a rotation of the stalk around the central axis also induces a rotation of said base part, the cleaning head may be easily rotated even in its use mode, when holding the cleaning head in this position. As a consequence, optional openings between the arms are no problem, since it is more easily possible to reach the total area to be cleaned.

When the fasteners are also based on a rotation around the central axis of said base part, like when using screw thread, it may be advantageous to also allow a tangential rotation, without the stalk being removed from the base part.

In another preferred embodiment of the cleaning head according to the invention, the cleaning head comprises pulling means, connected to the arms of the cleaning head, said pulling means being adjustable between a first position, wherein the arms are in the starting position, and a second position, wherein the free ends of the arms with respect of the starting position are pulled towards each other.

When the handle is provided with means to pull the arms towards each other, it will be simple to fold the arms towards each other with little effort, so as to remove any water present from the cleaning head, optionally with use of a bucket with a wring chamber, like a bucket with a pump and tube as mentioned hereafter.

In an especially preferred embodiment of the cleaning head according to the invention the pulling means comprise a handle and a wire that is placed between the arms and the handle in the stalk.

Embodying these pulling means as a handle and a thread or wire allows for a simple and reliable construction.

The present invention further relates to a combination of a cleaning head according to any of the preceding claims, a water permeable bag that is placed around the cleaning head, and cleaning members that are clamped between the arms of the cleaning head, wherein at least one main dimension of the cleaning members is larger than the opening between the arms of the cleaning head.

When the cleaning head, preferably without stalk, or after removing the stalk, is entered between the arms into a water permeable bag together with cleaning agents (like solid balls of soap or a similar kind of cleaning agent), wherein a main dimension (for example length, width or diameter) of the cleaning agents is larger than the opening between all adjacent arms, the effect is obtained that the cleaning agent at least during a first phase of the cleaning process can escape away from its position and between said arms. Thus, an efficient cleaning of the arms is obtained.

In a preferred embodiment of the combination according to the invention the bag mutually clamps the arms of the cleaning head together and around the cleaning members.

Although other solutions may be possible, it is preferred that the arms are clampingly engaged by the bag around the cleaning agents, since in such case the chance of premature escape of the cleaning agents is limited, and because in that case no additional means are required, like ropes or elastic bands, to clamp the arms together.

According to a further aspect, the invention also relates to a combination of a cleaning head according to the invention and a bucket, said bucket comprising: —a container with a bottom and an upright peripheral wall; —an extrusion chamber disposed within the circumferential wall with an outside wall and a twist plate displaceable within the extrusion chamber in the direction of a wring part of the outer wall; —wherein the outer wall has an upper edge on a side remote from the bottom of said bucket. This combination is characterized in that an opening is provided in the outer wall of the extrusion chamber over at least a part of the height of the outer wall from the upper edge towards the bottom of the bucket to bring the cleaning head through the recess into the extrusion chamber. Such provides a simple rinsing and wringing of the cleaning head and which allows one to quickly efficiently use same for cleaning a floor, wall or the like and as identified above. A huge advantage of this embodiment is that the cleaning head in a first step can be pulled upward until it is entered into the extrusion chamber after which the wring plate squeezes a part of the water of the cleaning head. The cleaning head is positioned in an erect shape in the extrusion chamber which allows for a uniform squeezing.

It is especially preferred that the opening is provided at the side of the wring part of the outer wall, since in such case the stalk that is connected to the cleaning head is positioned directly in the extrusion chamber and thus is in the right position to squeeze the cleaning head.

A further optimization of the squeezing process is obtained when in the extrusion chamber a valve is provided for closing off the opening and that in a starting situation abuts an inside of the outer wall, said valve releasing the opening when in a release situation bringing the cleaning head in the extrusion chamber and after having brought same into the extrusion chamber returning to the starting situation and closing off the opening. As a result, the complete cleaning head will abut a solid part, that means the outer wall and the plate, and as a consequence an efficient squeezing is obtained.

The invention also relates to a combination of a cleaning head according to the invention, and a bucket, said bucket comprising: —a container with a bottom and an upright peripheral wall; —an extrusion chamber disposed within the circumferential wall with a bottom and an upright elastic inner wall and a rigid outer wall, wherein an air duct is positioned in between said wall, and a water-permeable tube extending from the bottom in the center of the extrusion chamber, provided with openings; —a pump, with a hose that is connected to the peripheral wall of the extrusion chamber, for mutually abutting the free ends of the arms of the cleaning head against the tube.

With such pump that is positioned in the bucket, preferably integrated in the emmer, for example an air pump, like an electric air pump or a manually operated air pump, liquid may be removed from the cleaning head, without a user having to squeeze the cleaning head which is the case with existing buckets. The air stream that is induced by the air pump enters the chamber between the inner wall and the outer wall of the extrusion chamber though an air hose. Since the inner wall is more flexible than the rigid outer wall, the inner wall will be pushed inwardly. This wall will be positioned against the arms of the cleaning head that has been placed inside the extrusion chamber and push against the tube such that the arms lose liquid therefrom.

The extrusion chamber is provided with opening at the bottom side of the tube such that liquid that is squeezed out of the arms of the cleaning head will flow from the extrusion chamber into the main part of the bucket.

Such bucket may also be applied with other kinds of cleaning heads than the cleaning head according to the invention, with of without a tube.

These and other features of the invention will be described hereafter with reference to the accompanying drawing.

Figure 1:
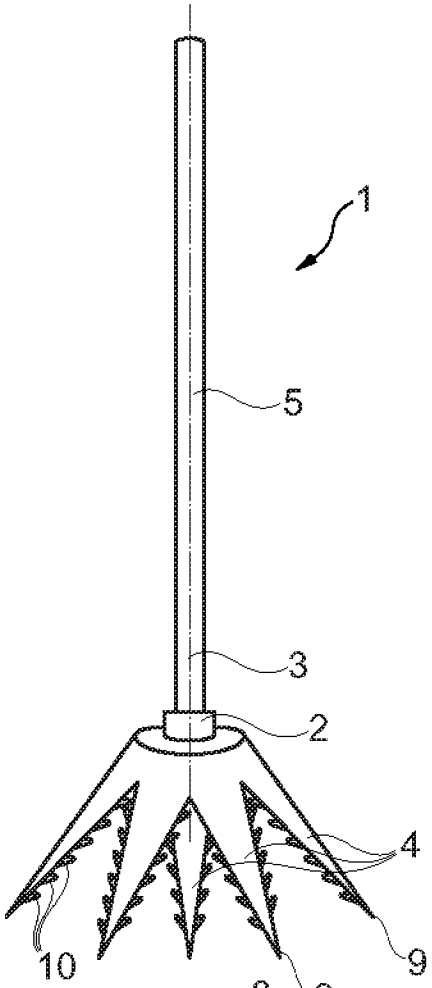
FIG. 1 shows a perspective view of a cleaning head according to the invention in de starting position.

FIG. 1 shows a cleaning head 1 with a base part 2 with a central axis 3. Around said base part 2 a number of arms 4 are provided in a regular pattern that extend in a radial direction with respect of a central axis 3. At said base part 2 a stalk 5 is connected.

In the starting position as shown the arms 4 rest on a floor 8 with the pointed free ends 9 of the arms 4 in an inverted bowl shape. At all sides of the arms 4, at an angle with the longitudinal direction of the arms 4 and directed towards the central axis 3, three protrusions 10 are provided, for retaining therein dirt 11 (see FIG. 2).

Figure 3:
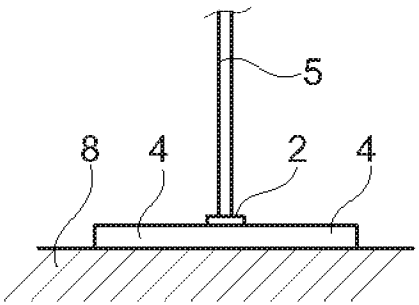
FIG. 3 shows a side view of a cleaning head according to the invention in de use mode.
Figure 2:
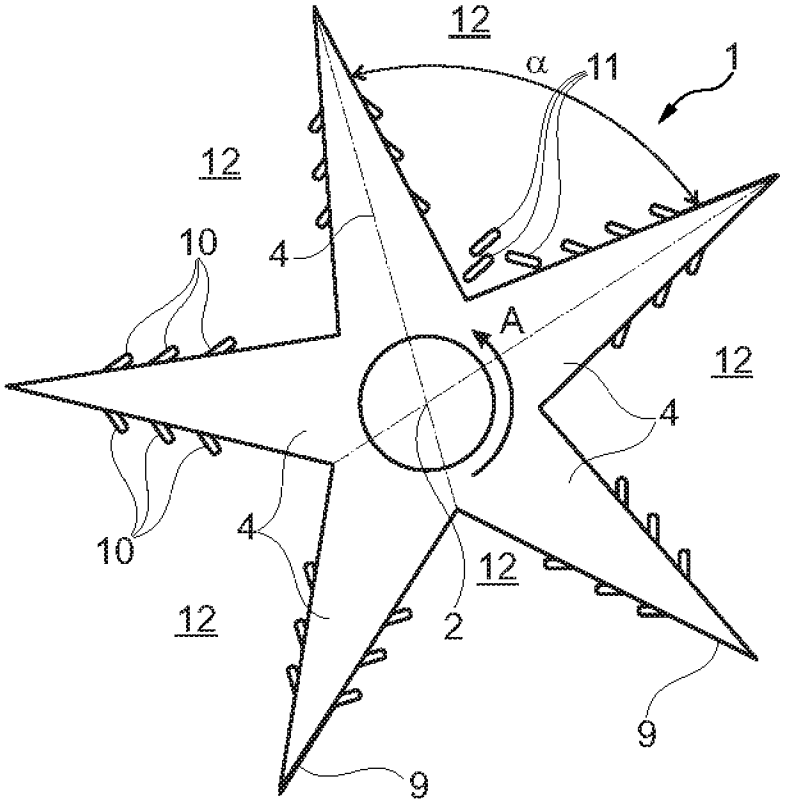
FIG. 2 shows a top view of a cleaning head according to the invention in de use mode.

In the FIGS. 2 and 3 the same cleaning head 1 in the use mode has been shown, however wherein the stalk 5 has not been shown. Upon rotation of the stalk 5 said base part 2 will rotate together with the arms 4, for example in the direction A. When the arms 4 abut a corner, an edge or an object, the arms 4 are able to shift with respect to each other in the use mode in a tangential direction by increasing or decreasing angle $\alpha$. This movement is allowed by the openings 12 between the arms 4.

Figure 4:
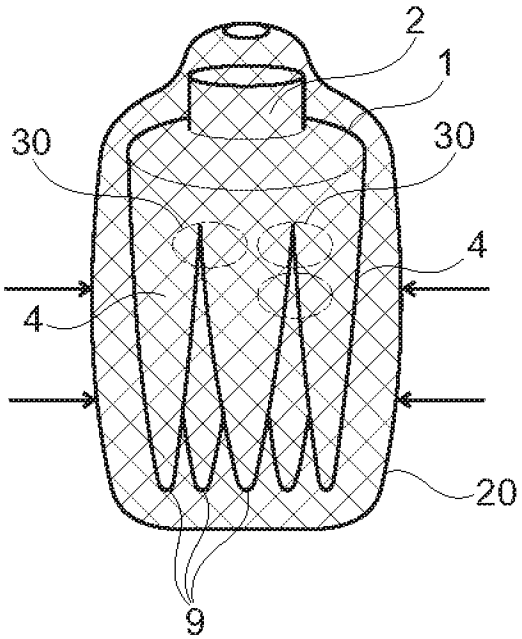
FIG. 4 shows a combination according to the invention.

FIG. 4 shows a cleaning head 1 according to the invention in a water permeable bag 20. De water permeable bag is elastic such that it can compress the arms 4 of the cleaning head 1 against each other. Between the arms 4 cleaning agent 30 is provided, that cannot escape between the arms 4, such that the arms 4 can be cleaned well.

Figure 5:
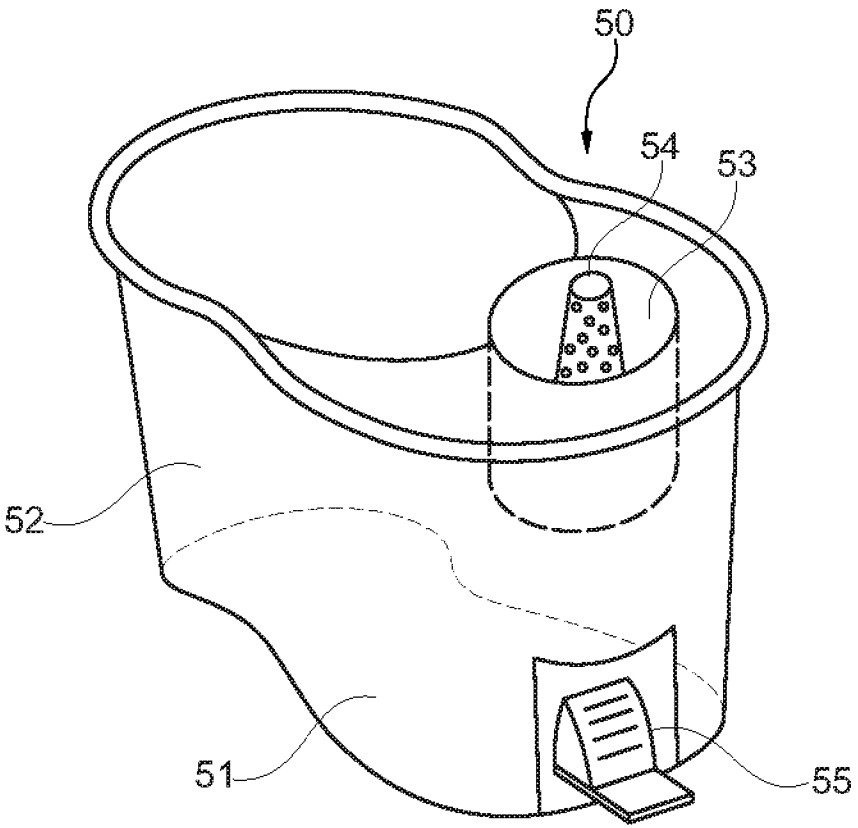
FIG. 5 shows a perspective view of a bucket according to the invention.
Figure 7:
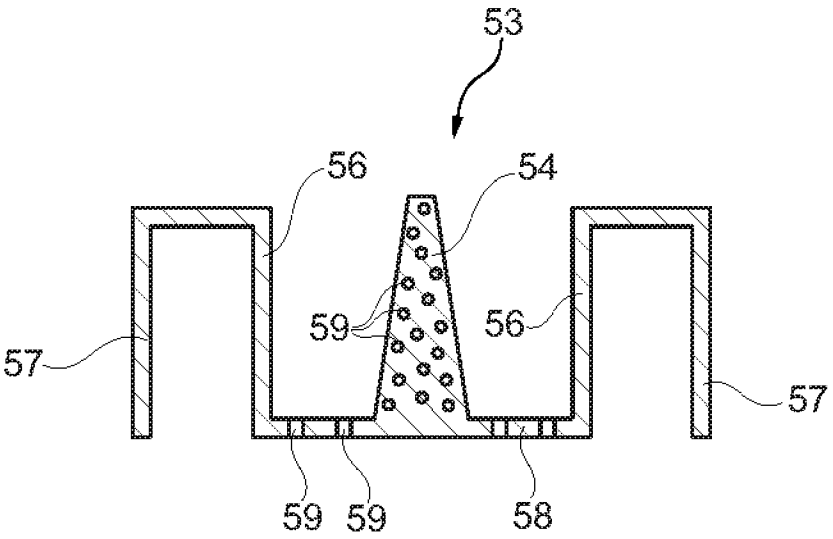
FIG. 7 shows a cross sectional view of an extrusion chamber according to FIG. 5.

FIGS. 5 and 7 show a bucket 50 with a bottom 51 and an upright peripheral wall 52. In the bucket 50 a wring chamber (or squeeze chamber) 53 has been provided, being provided with a tube 54 in the middle thereof. A pump 55 is connected to the space between the elastic inner wall 56 and the more rigid outer wall 57 of the squeeze chamber 53 by means of a hose (not shown) (see FIG. 7) so as to push the arms 4 of the cleaning head 1 against the tube 54 when it is positioned in the squeeze chamber 53. In the bottom 58 and the tube 54 openings 59 are provided, which are in connection with the main reservoir of the bucket 50.

Figure 6:
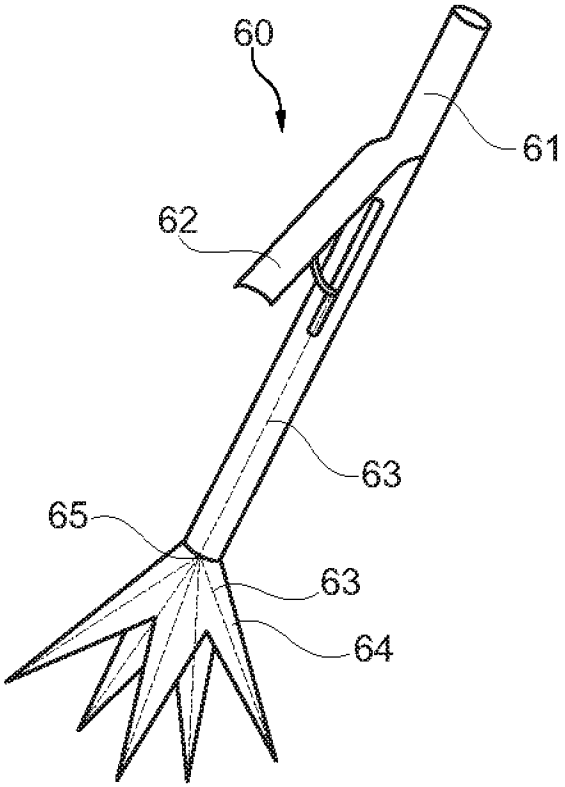
FIG. 6 shows a perspective view of an alternative embodiment of a cleaning head according to the invention in starting position.

In FIG. 6 an alternative embodiment 60 of the cleaning head of FIG. 1 is shown. The stalk 61 is provided with a pull handle 62, that by means of a wire 63 is in connection with the arms 64 via node 65. Upon operation of the pull handle 62 the arms 64 are pulled towards each other.

Figure 8:
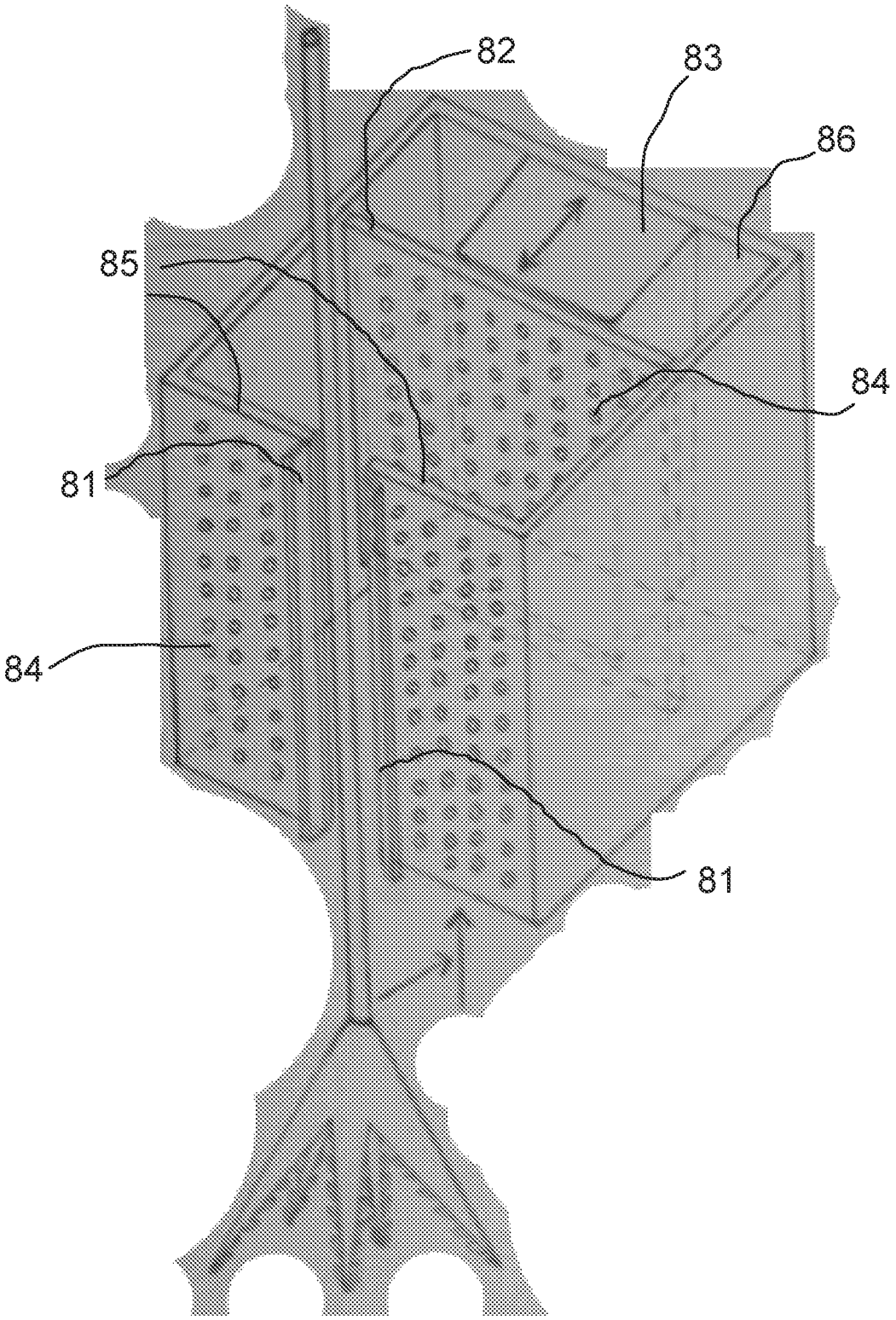
FIG. 8 shows a cross sectional view of an alternative extrusion chamber.
Figure 11:
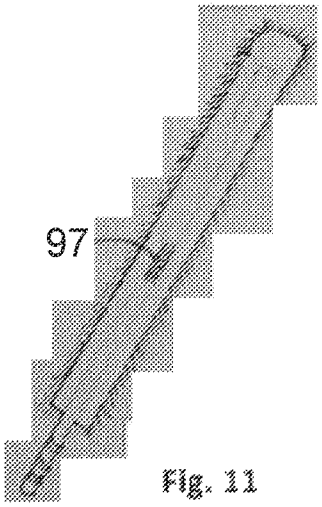
FIGS. 11-17 show alternative embodiments of a cleaning head according to the invention.
Figure 12:
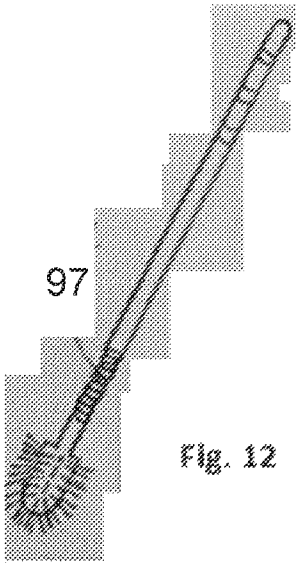
Figure 13:
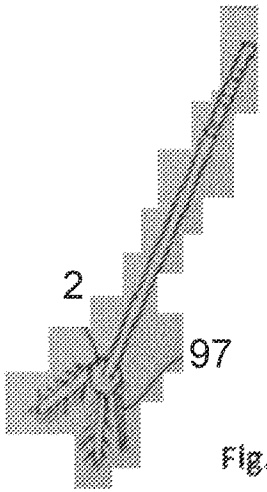
Figure 14:
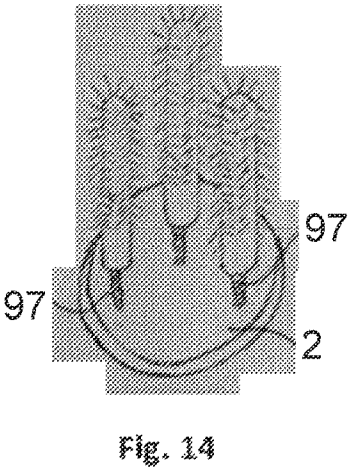
Figure 15:
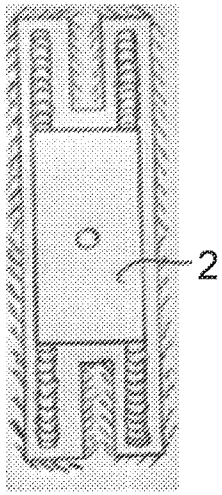

FIG. 8 shows an alternative embodiment of an extrusion chamber that can be placed in a bucket, wherein the extrusion chamber, also identified as "press chamber" or "squeeze chamber" has no bottom and along its circumference in the outer wall is provided with an opening 81 opposite a movable squeeze wall 82. Via this opening 81 the stalk of the cleaning head can be inserted into the squeeze chamber of the extrusion chamber. During use, the cleaning head is positioned below the extrusion chamber, as is visible in this figure. A valve 87, for example a thin flexible plate 87 with spring memory (or sheets as leaf springs) which is connected to the outer wall directly behind the opening 81, operates as a closable cover that immediately returns to its position against the outer wall as soon as the stalk is brought into the extrusion chamber. Subsequently, the stalk can be moved upwardly and at least partially out of the extrusion chamber, such that the user can place the cleaning head via the lower side of the squeeze chamber in a position between the outer wall and the movable squeeze wall. By translating the squeeze wall into the direction of the outer wall with the opening, the liquid is squeezed out of the cleaning head. Plate 87 retains all wires and strips of the cleaning head inside the squeeze chamber. An inflatable air chamber 83 may for example be provided between the circumferential wall 86 and the movable squeeze wall 82. By pushing air into the air chamber 83, the movable press wall 82 (or squeeze wall) will push the cleaning head against the rigid wall 85. Moisture falls back into the bucket through openings 84.

Such opening 81 with this embodiment is also possible applicable in other kinds of presses and squeezers for other cleaning heads than the cleaning head according to the invention.

Figure 9:
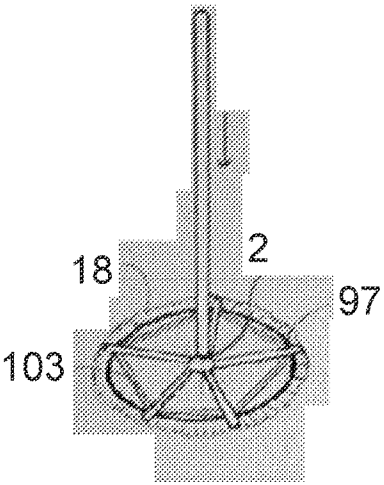
FIG. 9 shows a cleaning head with a stalk according to the invention.

FIG. 9 shows an alternative embodiment of a cleaning head according to the invention. In the use position as shown in this figure, the arms 97 are positioned against the surface to be cleaned and are all in a plane that is characterized by said surface. The textile material, rubber or other material that is known in the art for cleaning floors, windows, walls, other solid surfaces and sanitary products (herein also identified as "wires", "strips" and the like) is positioned between the arms and the surface to be cleaned. The textile has a circular shape wherein the circumferential wall can be moved somewhat towards a position in between the free ends of the arms towards said base part due to the flexibility of the textile material.

The flexible arms 97 are flexible in all directions. The material 98 that is connected to the arms 97, in in a plane in the shape of for example a star, a flower or a circle.

By means of the ate least one flexible arm of the present cleaning head that advantage s obtained that the cleaning head can be moved easily along corners, edges or along objects like tables or chairs on a surface to be cleaned. It is also possible to reach multiple corners at the same time. Due to the arms according to the invention one can direct the wires or threads in the cleaning head according to the invention more easily towards the surface to be cleaned. In many cases, two adjacent arms will spread, but it is also possible that multiple arms will concentrate. The displacement of the free end or the arms may, for example, take place by a pivotal movement of the arms or deformation of the arms.

Due to the arms according to the invention the threads or strips will not overlay each other unnecessary. As a result, an increase of the surface that is cleaned will be more than 60%, compared with a regular cleaning head. The cleaning head according to the invention retains its shape when performing a cleaning action with the consequence that the contact surface of the cleaning head according to the invention in de use mode is at least twice as large as known cleaning heads, despite the use of similar threads, strips, fabric or strips, its shape or its weight.

The surface to be cleaned is increased with every movement. As a result, one can clean a surface twice as fast and more easily than when using other kinds of cleaning heads without the arms 97 according to the invention.

The arms 97 may, together with the fabric or other material coupled thereto, like the threads, strips, rubber and the like, in the starting position stand on a surface. Such is possible since the flexible arms 97 will push the base part away from the surface in its starting position (i.e. upwardly) and then allow for sufficient space such that air may reach the damp material easily and efficiently and thus allow the material to dry. The cleaning head with the fabric cleaning material coupled thereto, thus can easily dry which prevents bacterial growth and stench in the cleaning head.

Because of the added functionality of the flexible arms 97 in this embodiment of the cleaning head according to the invention the threads strips and the like will not be positioned unduly on top of each other which allows one to easily remove the dirt therefrom. This is advantageous in relation to other cleaning heads comprising threads, strips and the like, and is obtained by means of the arms 97.

Figure 10:
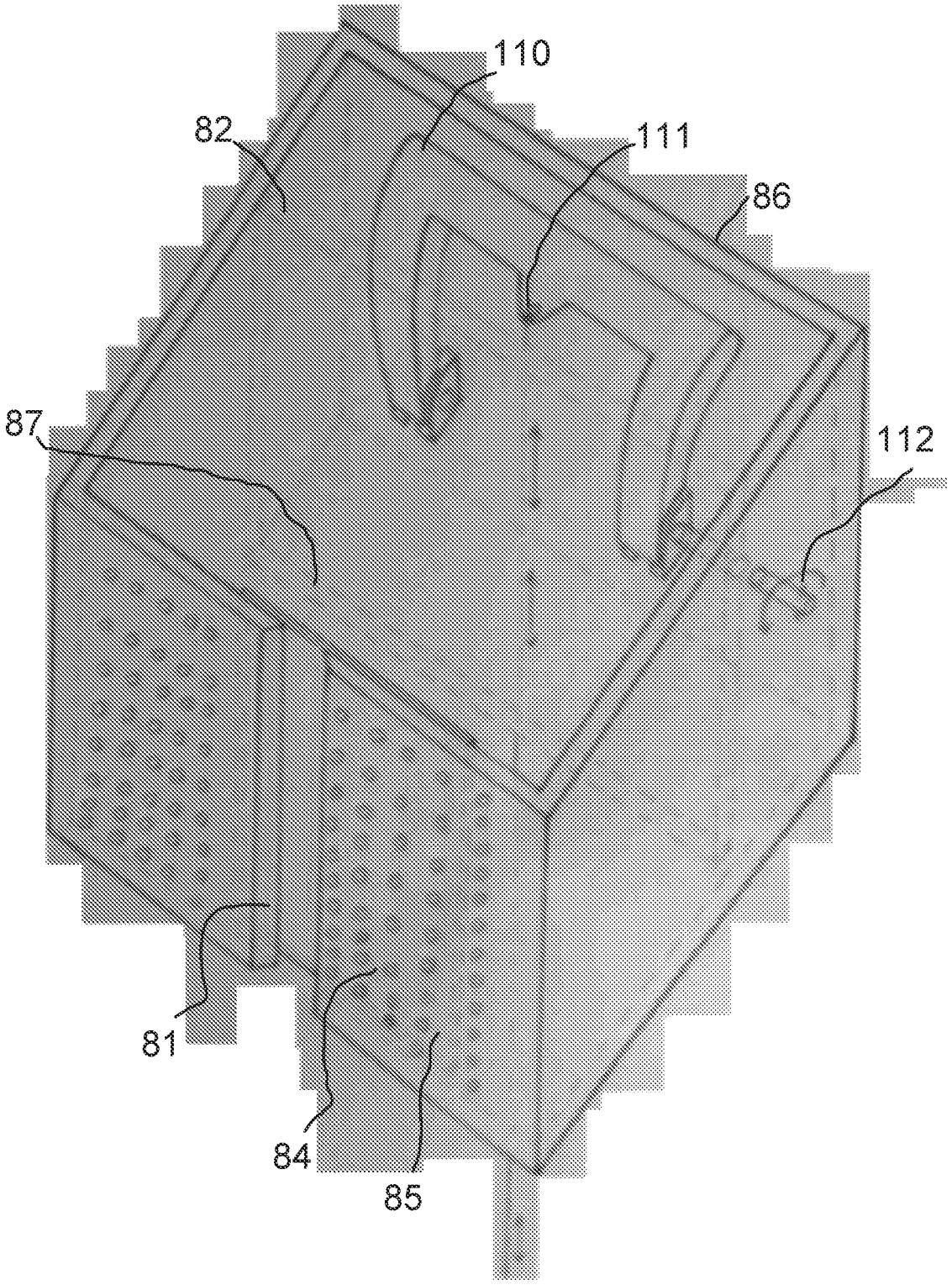
FIG. 10 shows a cross sectional view of another alternative extrusion chamber.

FIG. 10 shows an alternative embodiment of a squeezing apparatus that can be placed in a bucket. The squeezing apparatus has an extrusion chamber with an outer wall and a squeeze plate 82 that can be displaced towards a squeezing part of the outer wall within the extrusion chamber. The outer wall has an upper edge at a position directed away from the bottom of the bucket. In the outer wall of the extrusion chamber an opening or recess is provided at at least part of the height of the outer wall, from the upper edge towards the bottom of the bucket, for allowing one to bring the cleaning head into the extrusion chamber through this opening or recess.

As shown in the figure, the opening is provided at the side of the squeezing part of the outer wall such that the stalk and thus the cleaning head immediately enters the squeezing chamber.

As can be seen in the figure, a valve is provided that covers the opening in the extrusion chamber and that in a first position abuts an inside of the outer wall. This valve releases the opening when bringing the cleaning head into the extrusion chamber in a release position and returns to the first position after bringing the cleaning head into the extrusion chamber such that it covers the opening.

FIGS. 11, 12, 13, 14 and 15 show alternative embodiments of the cleaning head according to the invention, wherein one or more arms 97 are coupled to a base part and that for example are suitable for cleaning sanitary and other spaces and objects.

Figure 17:
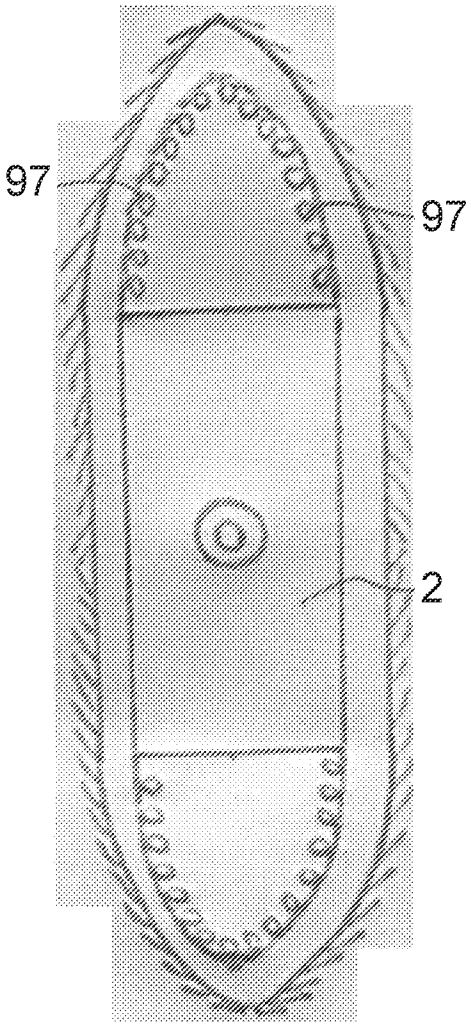
Figure 16:
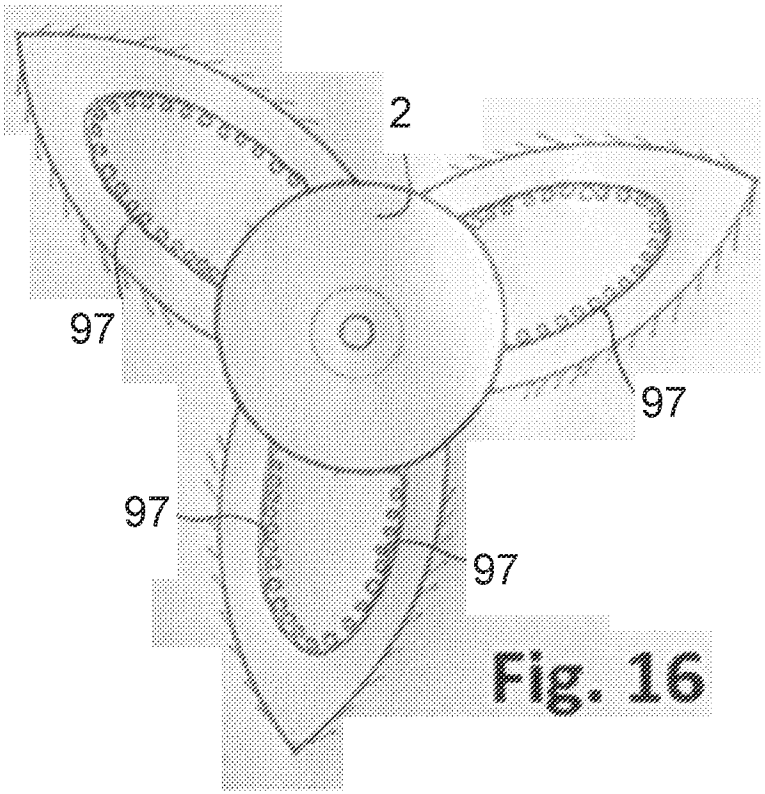

FIG. 16 and FIG. 17 show a special alternative embodiment of the cleaning head according to the invention. Herein, the arms 97 are embodied in duplicate, wherein a first end thereof is coupled to said base part and the free ends of two adjacent arms 97 are mutually coupled. Due to this construction, a somewhat more sturdy arm is obtained than when the arm 97 is embodied singly, for example as shown in FIGS. 11-15. Similarly, the arms 97 can be seen as a single arm, the ends of which are coupled to said base part. However, within the context of the present invention, two arms are on the one hand each provided with a first end connected to the base part and on the other hand another end connected to each other (i.e. mutually connected).

The shape of the cleaning head according to the invention and the fabric or the like as a material that removes dirt from the surface to be cleaned, is also applicable in other kinds of cleaning heads without or with flexible arms. The cleaning fabric according to the invention thus can be used in combination with every other cleaning head that has substantially rigid arms so as to reach multiple corners at the same time with a smooth and harmonious movement for removing dirt and dust better and easily and to send it to a desired place during cleaning. For example, this shape of arms in a cleaning head may be the shape of a star, a flower, a propeller, a character S, a character X or the shape of a plus-sign (+); examples hereof are shown in FIGS. 1, 13, 15 and 16. Other shapes of cleaning heads and fabrics, especially with openings or recesses directed towards said base part are possible for realizing an improved cleaning result.

The invention claimed is:

1. A cleaning head, comprising:

a base part with a central axis; and a number of arms extending radially with respect to the central axis each having a first end that is connected to said base part, and a second free end, wherein said second end is displaceable between a starting position in which the second end of the arms is near the central axis, and a use mode wherein the second end of the arms is at a position remote from the central axis, and wherein the second ends of the arms in the use mode are in a same plane as said base part, characterized in that the arms in the use mode are bendable in tangential direction with respect to each other around said base part.

2. A cleaning head according to claim 1, wherein the cleaning head has cleaning zones in tangential direction at and preferably provided around the arms, and comprising openings that extend between the arms in the direction of said base part.

3. A cleaning head according to claim 2, wherein the cleaning zones of at least one arm are provided with protrusions at at least the outer side and at an angle with respect to the longitudinal direction of the arm, and preferably directed towards the central axis, for retaining dirt therein.

4. A cleaning head according to claim 1, wherein the arms comprise a spring or a memory material.

5. A cleaning head according to claim 1, wherein in the starting position at least three arms are provided in tangential direction evenly around said base part.

6. A cleaning head according to claim 1, wherein the number of arms is 3 or more, and less than 9.

7. A cleaning head according to claim 1, wherein the free end of at least one of said arms is sharply shaped, preferably with a diameter of less than 2 cm.

8. A cleaning head according to claim 1, further comprising a stalk that is connected to said base part by means of fasteners.

9. A cleaning head according to claim 8, wherein the stalk is connected non-rotatably in the fasteners such that said base part rotates upon rotation of the stalk around the central axis.

10. A cleaning head according to claim 8, wherein the cleaning head comprises pulling means, connected to the arms of the cleaning head, said pulling means being adjustable between a first position, wherein the arms are in the starting position, and a second position, wherein the free ends of the arms with respect of the starting position are pulled towards each other.

11. A cleaning head according to claim 10, wherein the pulling means comprise a handle and a wire that is placed between the arms and the handle in the stalk.

12. A combination of a cleaning head according to claim 1, a water permeable bag that is placed around the cleaning head, and cleaning members that are clamped between the arms of the cleaning head, wherein at least one main dimension of the cleaning members is larger than the opening between the arms of the cleaning head.

13. A combination according to claim 12, wherein the bag mutually clamps the arms of the cleaning head together and around the cleaning members.

14. A combination of a cleaning head according to claim 1, and a bucket, said bucket comprising:

a container with a bottom and an upright peripheral wall;

an extrusion chamber disposed within the circumferential wall with an outside wall and a twist plate displaceable within the extrusion chamber in the direction of a wring part of the outer wall;

wherein the outer wall has an upper edge on a side remote from the bottom of said bucket;

characterized in that an opening is provided in the outer wall of the extrusion chamber over at least a part of the height of the outer wall from the upper edge towards the bottom of the bucket to bring the cleaning head through the recess into the extrusion chamber.

15. A combination according to claim 14, wherein the opening is provided at the side of the wring part of the outer wall.

16. A combination according to claim 14, wherein in the extrusion chamber a valve is provided for closing off the opening and that in a starting situation abuts an inside of the outer wall, said valve releasing the opening when in a release situation bringing the cleaning head in the extrusion chamber and after having brought same into the extrusion chamber returning to the starting situation and closing off the opening.

17. A combination of a cleaning head according to claim 1, and a bucket, said bucket comprising:

a container with a bottom and an upright peripheral wall;

an extrusion chamber disposed within the circumferential wall with a bottom and an upright elastic inner wall and a rigid outer wall, wherein an air duct is positioned in between said wall, and a water-permeable tube extending from the bottom in the center of the extrusion chamber, provided with openings;

a pump, with a hose that is connected to the peripheral wall of the extrusion chamber, for mutually abutting the free ends of the arms of the cleaning head against the tube.

* * * * *